United States Patent [19]

Goodspeed

[11] Patent Number: 4,706,324

[45] Date of Patent: Nov. 17, 1987

[54] APPARATUS FOR AUTOMATICALLY CLEANING SMELT SPOUTS OF A CHEMICAL RECOVERY FURNACE

[76] Inventor: Byron L. Goodspeed, 1111 Holcomb Rd., Kelso, Wash. 98626

[21] Appl. No.: 919,969

[22] Filed: Oct. 17, 1986

[51] Int. Cl.[4] ..... D21C 11/00

[52] U.S. Cl. ..... 15/246; 15/93 R; 162/272; 266/269

[58] Field of Search ..... 15/93 R, 246; 266/269; 162/48, 272

[56] References Cited

U.S. PATENT DOCUMENTS 570,129 10/1896 Hartman ..... 266/269

4,423,533 1/1984 Goodspeed ..... 15/246

*Primary Examiner*—Edward L. Roberts

*Attorney, Agent, or Firm*—Dellett,Smith-Hill & Bedell

[57] ABSTRACT

Removable apparatus for cleaning obstructions such as oxidized or encrusted smelt from a smelt spout of a chemical recovery furnace. A metal cleaning head having a rod-like shape depends, at rest, from a housing attached exteriorly of the furnace above the smelt spout. Periodically, an actuating mechanism in the housing moves the cleaning head downward and inward into the smelt spout to dislodge any obstructions that may have accumulated therein, and subsequently retracts the cleaning head to the at-rest position. Channel scraping members attached to the cleaning head are hinged to retract upon insertion of the cleaning head into the smelt spout an extend into the smelt spout channel to urge obstructions out of the channel when the cleaning head is retracted.

20 Claims, 12 Drawing Figures

APPARATUS FOR AUTOMATICALLY CLEANING SMELT SPOUTS OF A CHEMICAL RECOVERY FURNACE

BACKGROUND OF THE INVENTION

The present invention relates to recovery furnaces and particularly to apparatus for automatically cleaning spouts that drain molten chemical-containing smelt from the firebox of a chemical recovery furnace.

Wood pulp for papermaking is usually manufactured according to the sulfate process wherein wood chips are treated with a cooking liquor including sodium sulfide and sodium hydroxide. The wood chips and the cooking liquor, called "white liquor, " are cooked in a digester under predetermined heat and temperature conditions. After cooking, the used liquor, termed "black liquor," containing spent cooking chemicals and soluble residue from the cook, is washed out of the pulp and treated in a recovery unit where the cooking chemicals are reclaimed. Without reclamation and reuse of the cooking chemicals, the cost of the papermaking process would be prohibitive.

In the recovery process, the black liquor is first concentrated by evaporation to a water solution containing about 65 percent solids, which solution is then sprayed into the firebox of a black liquor recovery boiler, a type of chemical reduction furnace. The chemical reduction furnace is a reactor wherein the processes of evaporation, gasification, pyrolysis, oxidation and reduction all occur interdependently during recovery of the cooking chemicals. The organic materials in the black liquor, lignin and other wood extracts, maintain combustion in the firebox, and the heat produced dries the spent cooking chemicals as they fall to the floor of the firebox, where they build a mound of material called a char bed. The char bed is further heated to liquify the chemicals into a molten smelt that flows out through a smelt spout in the bottom of the furnace to a collection tank. Concurrently, combustion heat of the furnace is employed to generate steam in an interiorly disposed water-wall tubs boiler for use as process steam and for generating electricity.

The combustion process requires the introduction of large volumes of air into the firebox, air comprising about 80 percent of the material entering the furnace. The air is forced into the fire box from wind boxes or ducts disposed at several levels in surrounding relationship to the firebox, through a plurality of air ports in the walls of the furnace, viz.: primary, secondary and tertiary air ports. The primary air ports, through which about 40 to 50 percent of the air enters the furnace, are disposed on the side walls of the firebox near the bottom of the furnace close to the char bed. The secondary air ports, through which about 35 percent of the air enters the furnace, are disposed around the walls of the firebox, higher than the primary air ports, and below the entry conduits through which the black liquor is sprayed into the furnace. While the primary air ports provide a relatively large volume of air with considerable turbulence for maintaining a fireball in the char bed, the secondary air ports provide a finer control and distribution of air above the char bed and distribute the air evenly in the black liquor spray to support the combustion thereof.

The black liquor sprayed into the firebox, having a consistency like warm 60 weight oil, swirls, burns and falls toward the bottom of the firebox in the form of combustion products comprising char material and smelt. Some smelt and char material contact the outer walls of the firebox and, cooled by the inflowing air, form excrescent deposits around edges of the air ports. In accordance with customary practice, the char buildup is periodically dislodged, either manually by a worker inserting a rod into the air ports around the boiler, or by automatic cleaning apparatus. The dislodged char material falls into the smelt pool in the bottom of the furnace. Smelt spouts are designed to drain the smelt from the furnace, and keep the smelt pool at a safe level. If a smelt spout is not cleaned periodically, the smelt oxidizes and forms a crust which will, in time, clog the smelt spout. Clogged smelt spouts can cause the level of smelt inside the furnace to rise, resulting in inefficient and unpredictable furnace operation, with an attendant decrease in the amount of chemicals that can be recovered, a decrease in the amount of steam produced per unit of fuel, and increased emission of noxious gases such as carbon monoxide and sulfur dioxide.

Smelt spouts of chemical-recovery furnaces have heretofore been cleaned manually by a worker inserting a long metal rod into the spout. Vigorous lateral and reciprocating movement of the rod by the worker dislodges any char or encrusted smelt that may be clogging the spout. Such manual rodding of the smelt spout is inefficient and also unsafe. The temperature of the smelt is 800 to 1000 degrees Celsius, and although the rods utilized to clean the spouts are in excess of 6 meters long, there is danger that a worker who manually rods the smelt spout can be burned. Smelt spout openings are cooled by water circulating in a jacket surrounding the spout, and the water jacket can be ruptured by the manual rodding operation. A broken water jacket may result in an explosion of the recovery furnace because of the volatility of the smelt in the presence of water.

Apparatus for cleaning openings in a recovery furnace are known—see my U.S. Pat. No. 4,423,533, entitled FURNACE AIR PORT CLEANER; however, such known apparatus are not suitable for cleaning smelt spouts. Conventional punching devices, rods or cleaners inserted into the smelt spouts are inefficient and unsafe to use.

It is accordingly an object of the present invention to provide improved apparatus for cleaning smelt spouts of a chemical recovery furnace.

It is another object of the present invention to provide improved smelt-spout cleaning apparatus installable for automatic operation in a smelt spout of a chemical recovery furnace.

Another object of the present invention is to provide improved smelt spout cleaning apparatus for increasing the operational stability of a black liquor recovery boiler.

It is a further object of the present invention to provide improved automatic smelt spout cleaning apparatus that will reduce the exposure of workers to hazardous areas of the chemical recovery furnace.

Yet another object of the instant invention is to provide improved automatic smelt spout cleaning apparatus that is safe to operate, and virtually eliminates the danger of rupturing a smelt spout cooling-water jacket.

Another object of the present invention is to provide improved automatic smelt spout cleaning apparatus that is relatively light in weight and can be manually installed on or removed from a chemical recovery furnace quickly and easily.

SUMMARY OF THE INVENTION

According to the present invention, smelt spouts of a chemical recovery furnace are cleaned automatically by apparatus comprising a cleaning head adapted for insertion into and through a smelt spout and depending from a removable housing attached adjacent to the smelt spout. The cleaning head is moved into the smelt spout and partially inside the firebox through the smelt spout opening. Means are provided for moving the cleaning head into the spout and for subsequently retracting the cleaning head for accomplishing the cleaning operation.

In a preferred embodiment of the invention the removable housing from which the cleaning head depends is suspended over the smelt spout from structure attached to the furnace ductwork or hood.

The cleaning head includes a cleaning tip which protrudes through the smelt spout, while an elongate rod having hinged scraping members attached thereto traverses a channel of the smelt spout, the scraping members cleaning the channel as the cleaning head is withdrawn from the smelt spout. A locking mechanism is provided to hold the cleaning head in a retracted or at-rest position.

The apparatus according to the instant invention is suitably operated at regular intervals on an automatically timed basis so as to keep the smelt spout substantially clear of encrusted smelt and char, resulting in improved stability of furnace operation. Consequently, more efficient recovery of chemicals is realized as well as an increase in steam production and decrease in the emission of pollutant gasses.

DRAWINGS

While the invention is set forth with particularity in the appended claims, other objects, features, the organization and method of operation of the invention will become more apparent, and the invention will best be understood by referring to the following detailed description in conjunction with the accompanying drawings in which:

DESCRIPTION OF THE PREFERRED EMBODIMENT

Figure 1:
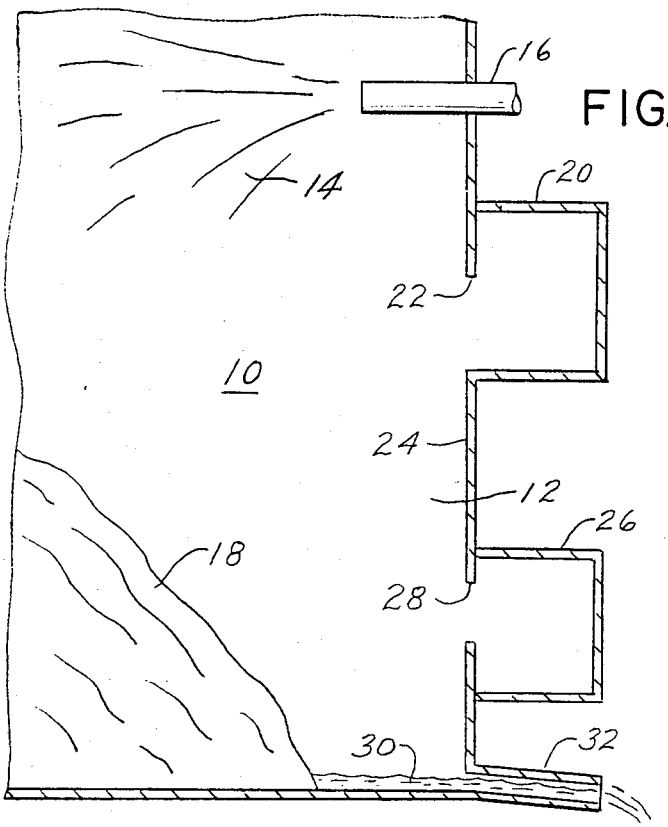
FIG. 1 is a schematic view of a portion of a black liquor recovery boiler with which the present invention is employed.

Referring now to the various views of the drawings for a more detailed description of the components, materials, construction, function, operation and other features of the instant invention by characters of reference, FIG. 1 shows a black liquor recovery boiler 10 which comprises a firebox 12 of a steam boiler. Black liquor 14, as hereinbefore described, is sprayed into the firebox 12 through a conduit or nozzle 16, where the organic materials therein are ignited, the chemicals being deposited on the floor of the firebox as a char bed 18.

A first wind box 20 substantially surrounds the firebox 12 and delivers combustion air under pressure into the firebox through a plurality of secondary air ports such as air port 22 formed in the wall 24 of the firebox 12 around the periphery thereof, above the char bed 18 and below the level of the black liquor entry conduit 16 or nozzle for supporting the initial combustion of the organic materials in the black liquor. A second wind box 26 substantially surrounds the firebox 12 and delivers combustion air under pressure into the firebox through a plurality of primary air ports 28 formed in the wall 24 of the firebox 12 around the periphery thereof at the level of the char bed 18 to maintain a fire in the char bed.

A molten chemical-containing smelt 30 recovered from the burning char bed 18 drains from the furnace through a smelt spout 32 disposed in the bottom of the firebox 12, the smelt 30 being collected for further processing.

Figure 2:
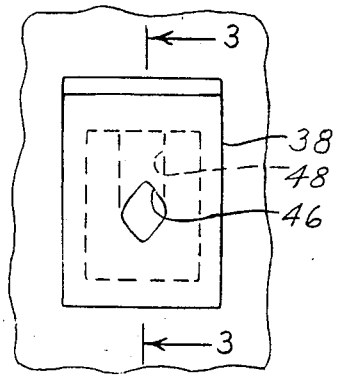
FIG. 2 is a view of a typical smelt spout of a chemical recovery furnace as viewed from inside the furnace.
Figure 3:
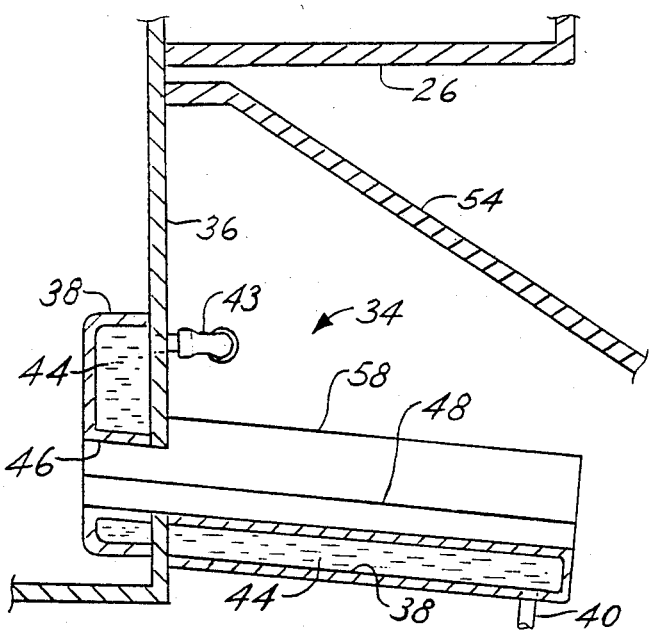
FIG. 3 is a view taken along lines 3—3 of FIG. 2.
Figure 4:
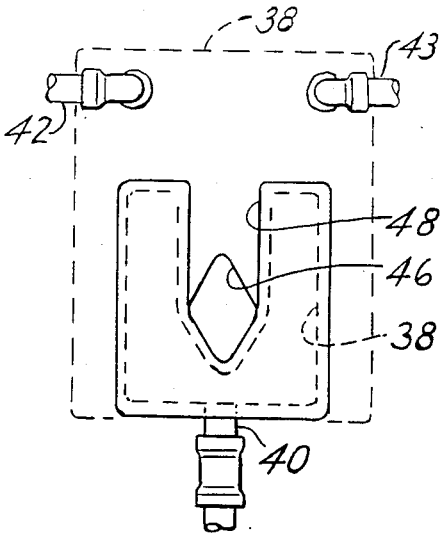
FIG. 4 is an end elevation view of a typical smelt spout of a chemical recovery furnace as viewed from outside the furnace.

Referring to FIGS. 2–4, a typical smelt spout 34 emplaced in a wall 36 of a chemical recovery furnace is shown in greater detail. A water jacket 38 having an input pipe 40 and an output pipes 42, 43 through which cooling water 44 flows, surrounds an opening 46 and a channel 48 through which smelt 30 flows from inside the furnace through the channel 48, which is disposed exteriorly of the furnace and extends outwardly from the opening 46. The channel 48 is formed in the steel-walled water jacket 38 through which the cooling water 44 circulates. The opening 46 and the channel 48 extending therefrom tilt downward about 15 degrees to allow the smelt 30 to drain from inside the furnace. Beneath the wind box 26, a metal hood or apron 54 extends outward in cantilever fashion and slants downward from the furnace wall 36 over the smelt spout 34 and its channel 48 to protect workers from both the intense heat of the smelt and the danger of chemical burns from splash.

Figure 5:
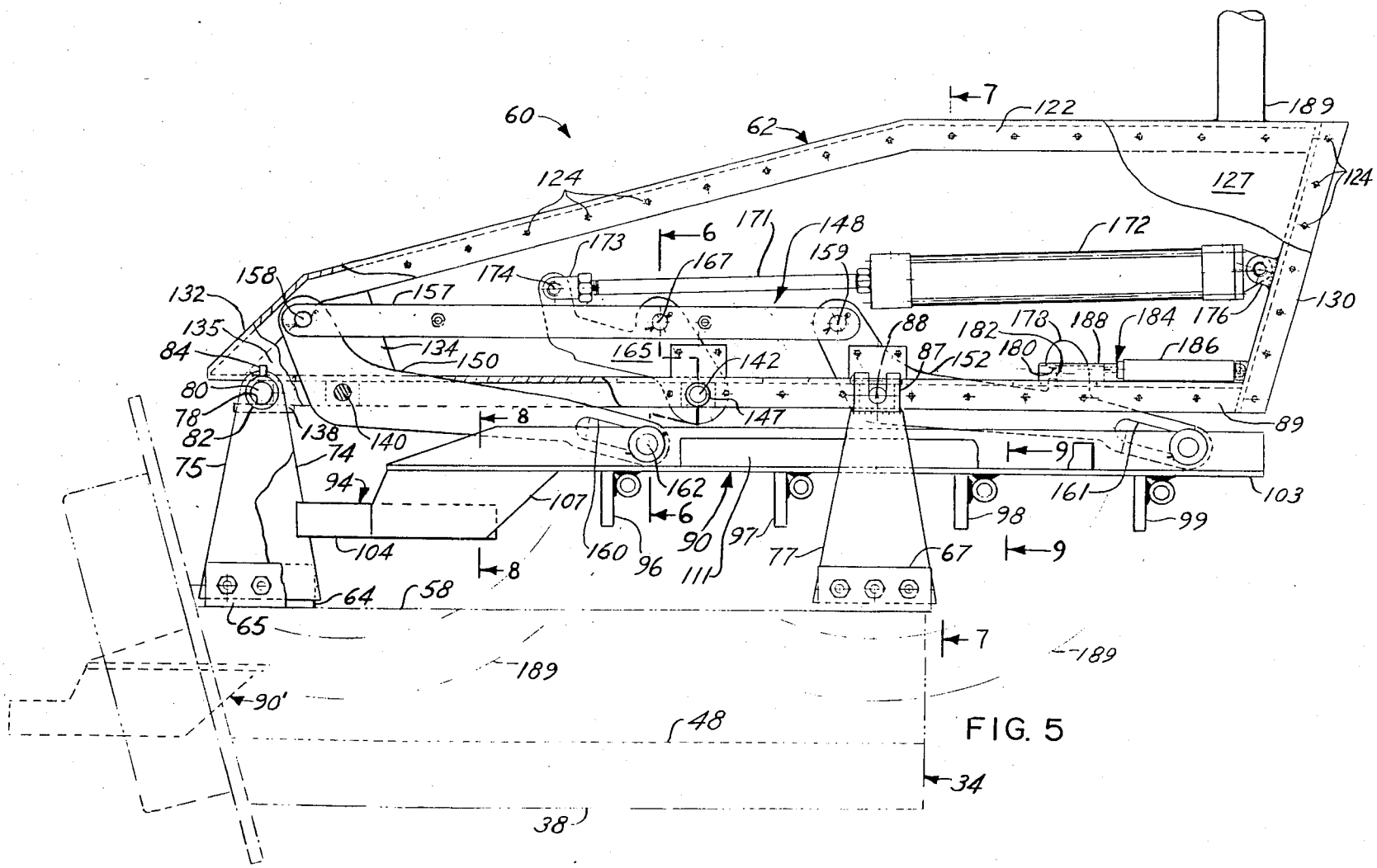
FIG. 5 is a side elevation view, partially cut away, of an automatic smelt spout cleaner in accordance with the present invention.
Figure 6:
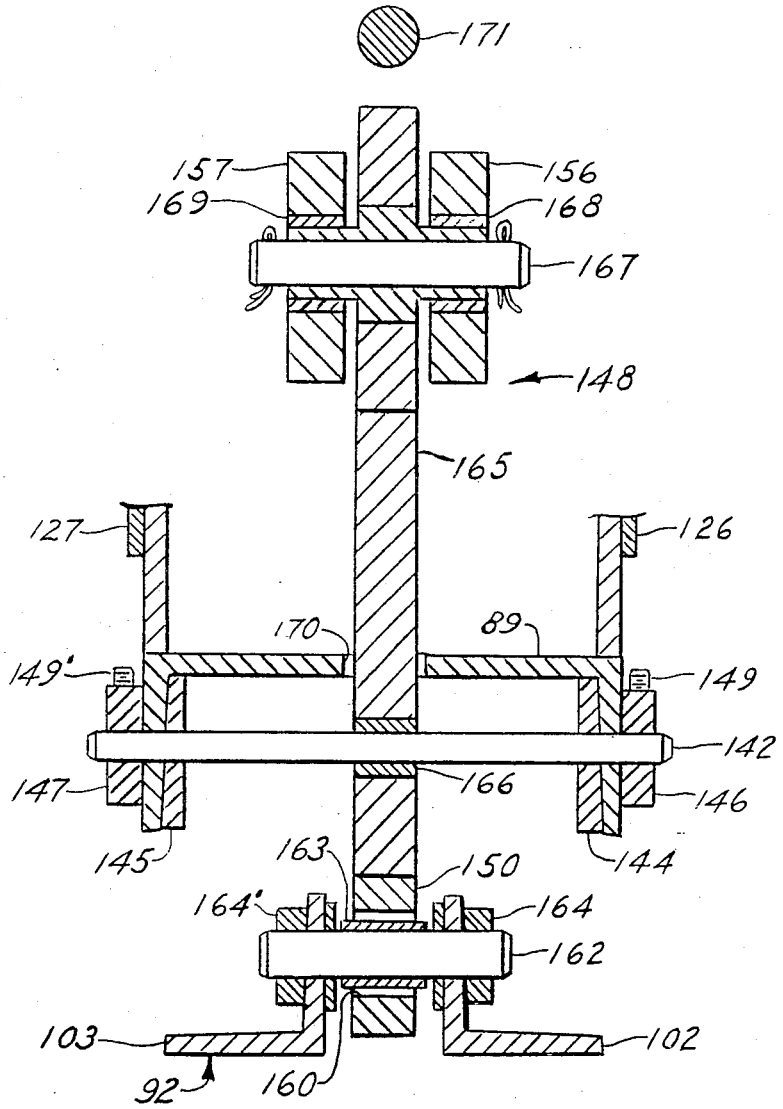
FIG. 6 is a modified cross-section view of an automatic smelt spout cleaner in accordance with the present invention taken generally along lines 6—6 of FIG. 5.
Figure 8:
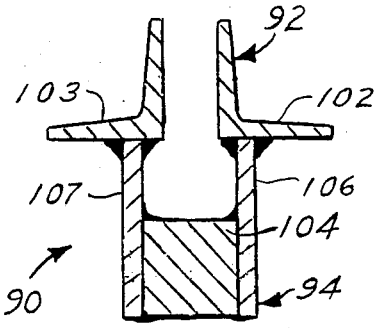
FIG. 8 is a cross section view of the cleaning head assembly of the present invention, taken generally along lines 8—8 of FIG. 5.
Figure 7:
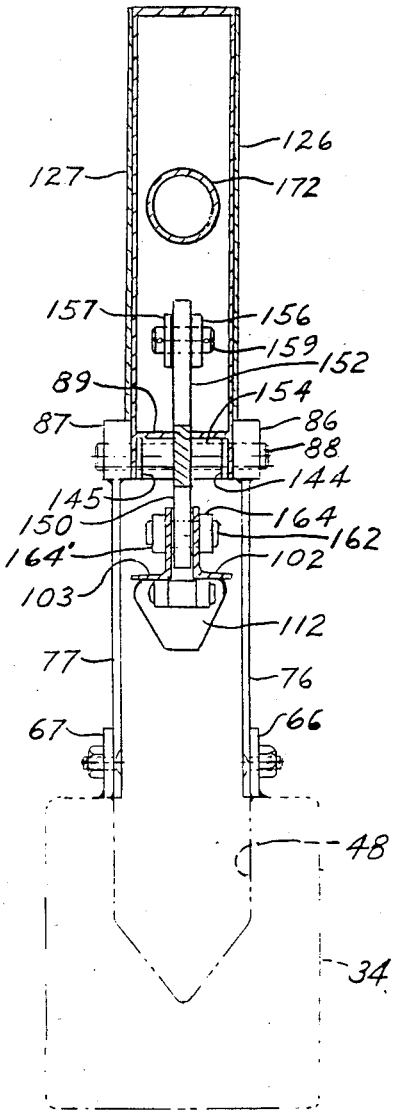
FIG. 7 is an end view of an automatic smelt spout cleaner in accordance with the instant invention, taken generally along lines 7—7 of FIG. 5.

Referring to FIGS. 5–9, an automatic smelt spout cleaner 60 in accordance with the instant invention is shown supported above a smelt spout 34, the latter being shown by broken lines in FIGS. 5 and 7. In accordance with one embodiment of the invention, mounting plates 64–67 for mounting and supporting the automatic smelt spout cleaner 60 may be welded in four places to upper edges 58 of the smelt spout water jacket 38 adjacent to the channel 48. In an alternate and preferred embodiment of the invention, described below with reference to FIGS. 11 and 12, the smelt spout cleaner 60 is suspended over the smelt spout 34 in the same relative position as shown in FIG. 5, but depending from the metal ductwork 26 above the smelt spout.

The automatic smelt spout cleaner 60, in the presently described embodiment, comprises a housing 62 supported above the channel 48 of the smelt spout by a pair of forward mounting arms 74, 75 attached with bolts and nuts to the mounting plates 64, 65, and a pair of rear mounting arms 76, 77 attached in a like manner to the mounting plates 66, 67. The forward mounting arms 74, 75 include holes (as illustrated by hole 78 in mounting arm 74, FIG. 5) drilled therethrough for receiving a forward mounting pin 80 transversely therebetween, the pin 80 being held in place by set collars 82 and set screws 84. The rear mounting arms 76, 77 (see FIGS. 5 and 7) each have welded thereto, respectively, a pillow block 86, 87 each receiving and supporting one protruding end of a pivot and mounting pin 88 centrally disposed in a base member 89 of the housing 62.

Supported beneath the housing 62 in a retracted position above the channel 48 is a cleaning head assembly 90 comprising an elongate rod 92, a cleaning tip assembly 94, and four pivoted channel-scraping members 96–99.

The elongate rod 92 of the cleaning head assembly 90 is made from two lengths of angle-iron stock 102, 103 disposed parallel to each other with one flange of each member 102, 103 facing downward, and the other flanges mutually facing each other and held spaced apart by the cleaning tip assembly 94 and channel-scraping members 96–99 attached to the downward-facing flanges. In the presently described embodiment of the invention, the cleaning tip assembly 94 comprises a length of bar stock 3 centimeters square and 20 centimeters long which forms a cleaning tip 104 attached by welding to a pair of plates 106, 107, each of the plates 106, 107 being welded to a respective one of the downward-facing flanges at one end of the elongate angle-iron members 102, 103. Metal bars 110, 111 are attached by welding to the angle-iron members 102, 103 of the elongate rod 92 to add weight and to stiffen the assembly. The elongate rod 92 including the stiffening bars 110, 111 and the cleaning tip assembly 94 are suitably fabricated from 316 stainless steel.

Figure 9:
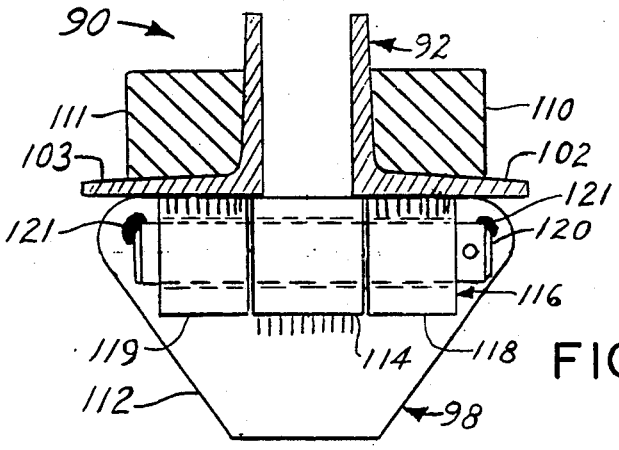
FIG. 9 is a cross-section view of a portion of a cleaning head assembly in accordance with the present invention, taken generally along lines 9—9 of FIG. 5.

The channel-scraping members 96–99, a representative one of which is shown in FIG. 9, each comprises a hinged plate 112 having a sleeve 114 affixed thereto as by welding, the sleeve 114 forming a central member of a hinge 116 which permits pivotal movement of the plate 112 with respect to the elongate rod 92. A pair of outboard sleeves 118, 119 welded, respectively, to the angle-iron members 102, 103 of the elongate rod 92, together with the sleeve 114, receive a hinge pin 120 which attaches the plate 112 pivotally to the rod 92. The pin 120 is free to rotate inside the sleeves 114, 118, 119 and is blocked from sliding out or being jarred from the hinge 116 by protrusions of weld metal 121 on the pin 120. Thus, if one of the outboard sleeves 118, 119 becomes clogged, freezing the pin 120 therein, the plate 112 and the pin 120 remain free to rotate with respect to the elongate rod 92, the pin 120 turning inside the other outboard sleeve and the central sleeve 114. The plate 112 is shaped similarly to the cross-sectional area of the bottom of the channel 48 (as best illustrated in FIG. 7) so as to fit therein during a cleaning operation as described hereinafter, and scrape encrusted smelt out of the channel 48.

Referring still to FIG. 5, the housing 62 comprises a frame 122 assembled from steel channel stock 7.6 centimeters wide at the base with side members extending 3.5 centimeters from the base, the side members being drilled and tapped in a plurality of locations 124 for attachment of side plates 126, 127 to both sides of the housing. The housing 62 is suitably a trapeziform solid framework approximately 122 centimeters long, 34 centimeters high at an end 130 thereof remote from the smelt spout opening 46 and tapering to a height of approximately 16 centimeters at the end 132 near the opening, and about 8 centimeters thick. Steel reinforcing plates 134, 135, welded to the frame 122 enclose the forward end 132 of the housing 62. A pillow block 138, laterally oriented with respect to the frame, is formed at the forward end of the housing 62 for engagement of the forward mounting pin 80 therein. The automatic smelt spout cleaner 60 of the present invention is completely portable, being manually installable on any smelt spout on which the mounting plates 64–67 and mounting arms 74–77 are installed. The housing 62 is easily carried by two workers and quickly and easily mounted onto the smelt spout, in the presently described embodiment, by first holding the housing with the forward end 132 thereof tilted slightly downward and engaging the forward pillow block 138 onto the mounting pin 80 between the forward mounting arms 74, 75, and then lowering the mounting pin 88 into the rear pillow blocks 86, 87 atop the rear mounting arms 76, 77. The smelt spout cleaner may be removed from the smelt spout quickly and easily, simply by lifting the housing off the mounting arms.

The pivot and mounting pin 88 and pivot pins 140, 142 are installed through the downwardly extending flanges of base member 89. Reinforcing bushings 144, 145, as shown typically in FIG. 6, are provided inside the flanges of the base member 89 for supporting the pins 88, 140, 142. Outer rings 146, 147 are welded to the base member 89 and provide additional support for the pin 142, while set screws 149, 149' affix the pin to the base member 89.

The rod 92 of cleaning head 90 forms one leg, i.e. the driven element, of a parallel shaft drive mechanism 148 housed substantially inside the housing 62. Parallel crank arms 150, 152 are pivotally affixed in the housing 62, respectively, by pivot pins 140, 88. Bushings such as bushing 154 (FIG. 7) hold the parallel crank arms centered inside the housing 62 and provide a bearing surface on which the crank arms 150, 152 pivot, respectively, about the pins 140, 88. Connecting rods 156, 157 together form another parallel element of the parallel shaft drive mechanism 148 opposite the rod 92, and pivotally connect the parallel crank arms 150, 152 together, respectively, by way of pivot pins 158, 159. The parallel crank arms 150, 152 are provided with elongated slots 160, 161 through which they are pivotally and slidably attached to the rod 92 of cleaning head 90. As shown in FIGS. 5 and 6, a pin 162 is received through apertures in the upwardly extending flanges of angle-iron stock 102, 103 of the rod 92 and through the slot 160, thereby holding the parallel crank arm 150 slidably affixed between the rod members 102, 103. A bushing 163, suitably made from 4140 chrome-molybdenum steel, provides a bearing surface against which the pin 162 rotates and against which the slotted arm 150 bears and/or slides. Outer rings 164, 164', welded to the angle-iron members 102, 103, hold the pin 162.

Referring to FIGS. 5 and 6, an actuating crank arm 165 of the parallel shaft drive mechanism 148 includes a bushing 166 pressed therein which pivots around the pivot pin 142 affixed to the base member 89 of the housing 62. The actuating crank arm 165 is connected pivotally to the connecting rods 156, 157 by a pivot pin 167 which rotates in bushings 168, 169 pressed into the rods 156, 157. The base member 89 of the housing 62 is slotted as illustrated typically by slot 170 FIG. 6, to allow passage therethrough of the parallel crank arms 150, 152 and the actuating crank arm 165. The actuating crank arm 165 is pivotally connected to an actuating rod 171 of a drive cylinder 172 by way of an adjustable clevis 173 and pin 174 for reciprocal movement with the actuating rod 171. The drive cylinder 172, preferably an air operated cylinder, is pivotally affixed to the frame 122 of the housing 62 by a clevis and pin 176. A locking member 178 extends upward from the rear parallel crank arm 152 and into the housing 62 through a slot in the base member 89 thereof, when the cleaning head is in the at-rest or retracted position. A slot 180 in the locking member 178 engages a locking pin 182 of a locking mechanism 184, the latter comprising an air operated cylinder 186 and an actuator linkage 188. The locking mechanism 184 locks the cleaning head 90 in the retracted position and prevents the cleaning head from sinking inadvertently or uncommanded into the smelt spout channel, as for example upon loss of pneumatic pressure in the drive cylinder 172, which could thereby block the flow of smelt through the channel 48.

A length of metal sleeve 189 having an aperture therethrough provides entry into the housing 62 for control elements such as pneumatic hoses, signal wires, etc., and provides protection of the control elements from the heat of the smelt. The sleeve 189 further provides a conduit for the introduction of cooling air under pressure into the housing 62 of the automatic smelt spout cleaner 60, the air passing over the components inside the housing and exiting through the slots (such as the slot 170, FIG. 6) in the base member 89. Cooling air exiting from the housing 62 also cools the cleaning head assembly 90 depending from the housing 62, and prevents dirt and other foreign matter in the hostile environment around the furnace from entering the housing 62. The life span of the automatic smelt spout cleaner 60 is thus considerably extended by maintaining a clean environment inside the housing 62 and by cooling the actuating mechanism and the cleaning head.

When the locking mechanism 184 is actuated to release the locking pin 182 from the slot 180, and thereafter the drive cylinder 172 is actuated, the actuating rod 171 is pulled into the cylinder 172 and the motion is translated via the actuating crank arm 165, the connecting rods 156, 157, and the parallel crank arms 150, 152 to the cleaning head 90 which swings downward toward and into the channel 48 of the smelt spout, the cleaning tip 104 protruding through the smelt spout opening 46 (as represented by the dashed-line position of the cleaning head 90') to dislodge any encrusted smelt which may block the smelt spout opening 46. The arcuate path of the parallel crank arms 150, 152 is illustrated by the dashed lines 189 of FIG. 5.

Figure 10:
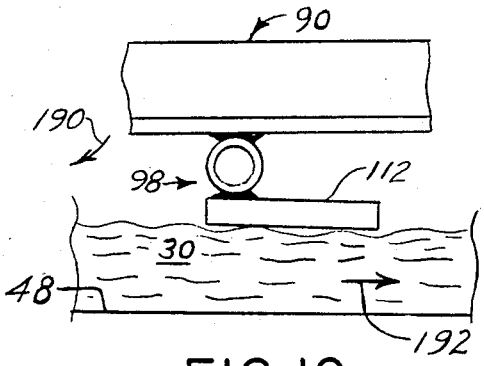
FIG. 10 shows a channel-scraping member according to the present invention in a retracted position.

Referring to FIG. 10, as the cleaning head 90 swings forward and downward (as indicated by the arrow 190), the channel-scraping members such as the representative channel-scraping member 98 contact the smelt 30 in the channel 48 of the smelt spout, and the hinged plate 112 pivots to the position shown in FIG. 10 allowing the smelt 30 to flow in the direction of the arrow 192. Further, if obstructions such as encrusted or solidified smelt are present in the channel 48, the plate 112 pivots to the position shown and passes over the obstruction. Referring to FIG. 5, the elongated slots 160, 161 in the parallel crank arms 150, 152 further allow the cleaning head 90 in motion entering the smelt spout to ride up and over any solid obstruction encountered, thereby precluding damage to the smelt spout such as puncture of the water jacket 38. Upon reversing the action of the actuating cylinder 172 to withdraw the cleaning head 90 from the smelt spout, the plate 112 pivots back to the position as shown in FIGS. 5, 7 and 9, thereby scraping the smelt spout channel 48 and urging any obstructions therein out of the spout in the direction of the arrow 192, FIG. 10.

Figure 12:
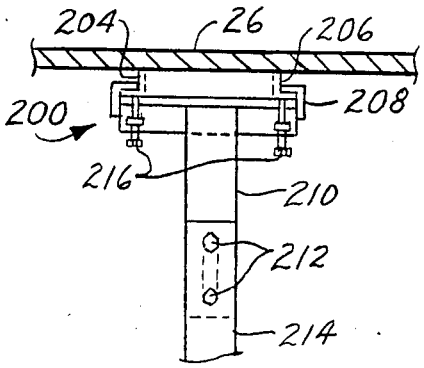
FIG. 12 is a cross-section view of the preferred mounting means according to the present invention, taken generally along lines 12—12 of FIG. 11.
Figure 11:
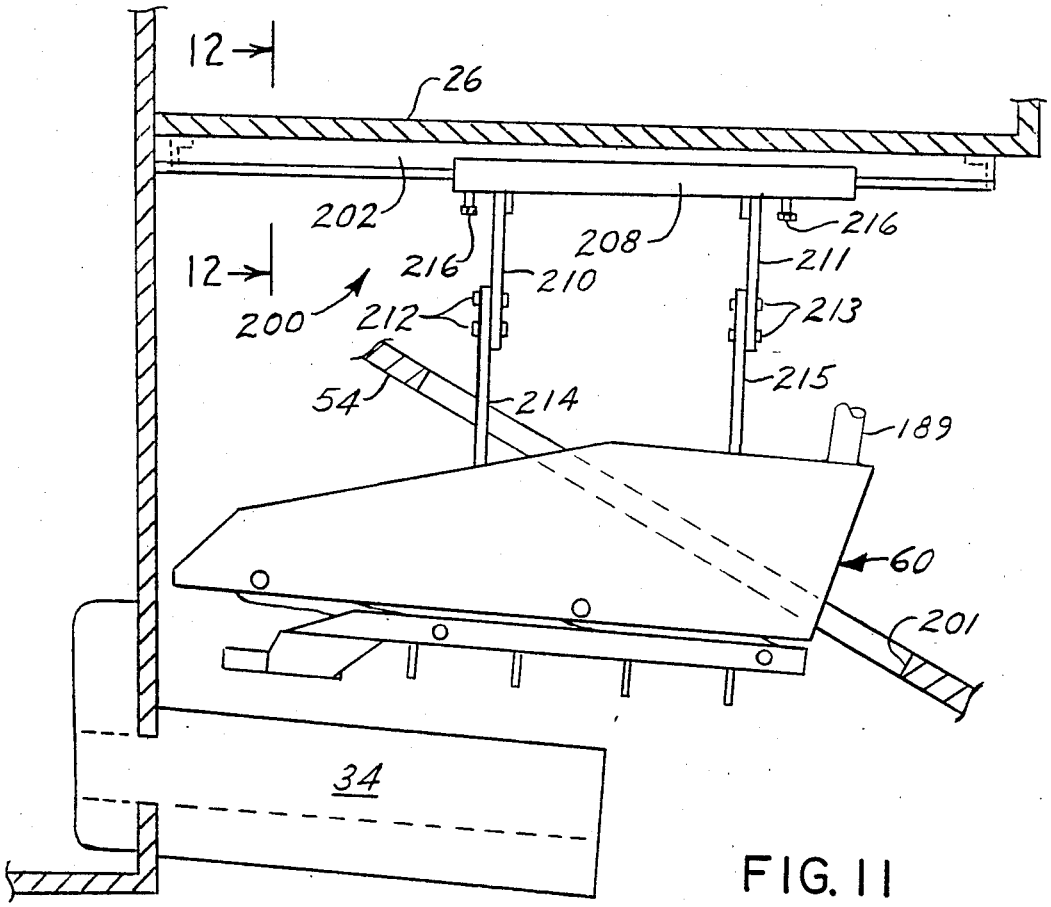
FIG. 11 illustrates a preferred means for mounting an automatic smelt spout cleaner in accordance with the present invention.

Referring to FIGS. 11 and 12, according to a best mode embodiment of the present invention, a support and hanger assembly 200 attached to the automatic smelt spout cleaner 60 as by welding, holds the cleaner 60 suspended from the metal ductwork or windbox 26 of the furnace disposed above the smelt spout 34. An aperture 201 is provided in the metal hood 54 for emplacement of the housing 60. A support frame 202 constructed of parallel members 204, 206 of angle-iron stock is attached as by welding to the wind box 26. The support frame 202 acts as a pair of rails onto which a smaller hanger frame 208, also made of angle-iron stock, is slidably engaged. Metal plates 210, 211 depending from the hanger frame 208 and welded thereto, are attached by bolts 212, 213 to corresponding metal plates 214, 215 welded to the smelt spout cleaner 60. Vertically slotted apertures in the plates 210, 211 allow adjustment of the cleaner 60 height above the smelt spout 34, and the angle of the cleaner with respect to the smelt spout. Locking bolts 216 are provided for fastening the hanger frame 208 securely to the support frame 202. The automatic smelt spout cleaner 60 is easily carried by two workers and quickly and easily installed to the smelt spout by sliding the hanger frame 208 onto the support frame 202, tightening the bolts 216 and connecting the control lines and cooling air to the conduit 189. The cleaner 60 may as readily be removed. The presently described embodiment of the invention utilizing the support and hanger assembly 200 was found to be preferable in that there is no metal-to-metal contact between the cleaner 60 and the smelt spout 34, thereby virtually eliminating any mechanical vibration or shock that may be present when the cleaner is mounted directly on the smelt spout.

FIG. 5 illustrates the cleaning head 90 locked in an at-rest or retracted position, withdrawn from the smelt spout. It will be observed that the temperature inside the firebox and the temperature of the smelt in the smelt spout channel is normally much hotter than the region above the smelt spout where the cleaning head 90 normally resides retracted, and consequently the cleaning head is protected to a degree from the excessive temperatures of the firebox and the smelt except for a brief period of use. At timed intervals, e.g. about every 10–12 minutes, the locking mechanism 184 and then the cylinder 172 are actuated to swing the cleaning head 90 into the smelt spout to the position 90' as illustrated in FIG. 5. The cylinder 172 is then operated in the reverse direction to retract the cleaning head 90 from the smelt spout back to its original at-rest and locked position.

While the principles of the invention have now been made clear in the foregoing illustrative embodiment, there will be immediately obvious to those skilled in the art many modifications of structure, arrangement, proportions, the elements, material and components used in the practice of the invention, and otherwise, which are particularly adapted for specific environments and operating requirements without departing from those principles. The appended claims are, therefore, intended to cover and embrace any such modifications, within the limits only of the true spirit and scope of the invention.

I claim:

1. Apparatus for automatically cleaning a smelt spout of a chemical recovery furnace, comprising:

a cleaning head insertable in said smelt spout for dislodging obstructions therein, actuating means for inserting said cleaning head into said smelt spout and subsequently retracting said cleaning head from said smelt spout, and means mountable adjacent to said smelt spout for housing said actuating means.

2. The apparatus according to claim 1 further comprising means in said housing for holding said cleaning head in a retracted position away from said smelt spout.

3. The apparatus according to claim 1 further comprising means attached to said cleaning head for urging the obstructions out of the smelt spout when said cleaning head is being retracted.

4. The apparatus according to claim 3, wherein said means for urging the obstructions out of the smelt spout comprises a retractable scraping member adapted for retraction when said cleaning head is being inserted into said smelt spout.

5. The apparatus according to claim 1 further comprising means for said cleaning head overriding obstructions in said smelt spout as said cleaning head is inserted into said smelt spout.

6. The apparatus according to claim 1 wherein said cleaning head comprises an elongate member depending from said housing and insertable in a channel of said smelt spout through which smelt normally flows out of said furnace.

7. The apparatus according to claim 6 wherein said cleaning head comprises a rod attached to said elongate member and depending from one end thereof in substantially parallel relation with said elongate member, said rod being insertable in an opening of said smelt spout in said furnace.

8. The apparatus according to claim 6, wherein said cleaning head comprises a channel-scraping member depending from said elongate member into the channel when said elongate member is inserted in the channel.

9. The apparatus according to claim 8, wherein said channel-scraping member comprises a plate having a shape substantially like a cross-section of the channel, said channel-scraping member being hinged to said elongate member so that said channel-scraping member retracts out of the way of the flowing smelt and obstructions in the channel when said cleaning head is inserted in the channel, and extends downward substantially perpendicular to said elongate member into the channel when said cleaning head is being retracted from the channel to thereby urge obstructions from the channel.

10. The apparatus according to claim 1 further comprising means for cooling said smelt spout cleaner.

11. The apparatus according to claim 10 wherein said cooling means comprises air forced into said housing means.

12. Apparatus for automatically cleaning a smelt spout of a chemical recovery furnace, comprising:

a housing affixed adjacent to said smelt spout;

an actuating mechanism substantially inside said housing; and a cleaning head attached to said actuating mechanism in a retracted position outside said smelt spout so as not to impede normal flow of smelt from said smelt spout, said actuating mechanism being operable to insert said cleaning head into said smelt spout to dislodge obstructions therein and to subsequently retract said cleaning head from said smelt spout to said retracted position.

13. Apparatus according to claim 12 wherein said cleaning head comprises an elongate rod depending from said actuating mechanism in substantially parallel relation with said smelt spout.

14. Apparatus according to claim 13, wherein said actuating mechanism comprises:

a parallel shaft drive mechanism including a pair of parallel crank arms each having a first end inside said housing, and a second end outside said housing attached pivotally to said elongate rod, said parallel crank arms each being rotatably affixed to said housing between the first and second ends thereof;

a connecting rod inside said housing and connected pivotally between the first ends of said parallel crank arms;

an actuating crank arm inside said housing and rotatably affixed to said housing, said actuating crank arm being pivotally connected to said connecting rod;

means inside said housing and coupled to said actuating crank arm for applying force to said actuating crank arm, whereby the force is translated through said parallel shaft drive mechanism to said cleaning head, said cleaning head being extended arcuately downward from said housing and forward into said smelt spout.

15. The apparatus according to claim 12 comprising a lock engageable with said actuating mechanism when said cleaning head is in said retracted position, said lock holding said cleaning head in said retracted position.

16. Apparatus for automatically cleaning a smelt spout of a chemical recovery furnace, said smelt spout being of a type including an opening in said furnace and having a channel extending outwardly from said opening exteriorly of said furnace, said apparatus comprising:

a housing attachable to said furnace above said smelt spout;

an actuating mechanism substantially inside said housing; and an elongate cleaning head insertable in said smelt spout and pivotally attached to said actuating mechanism exteriorly of said housing, said cleaning head being held in a retracted position above and outside said smelt spout so as not to impede normal flow of smelt from said smelt spout, said actuating mechanism being operable to swing said cleaning head downward and inward into said smelt spout to dislodge obstructions therein and to subsequently retract said cleaning head from said smelt spout to said retracted position.

17. The apparatus according to claim 16 wherein said actuating mechanism comprises a parallel shaft drive mechanism including a connecting rod disposed inside said housing parallel to said elongate cleaning head, a driving mechanism coupled to said connecting rod, said connecting rod coupling together a pair of parallel crank arms inside said housing, said parallel crank arms extending through openings in said housing and being connected to said elongate cleaning head.

18. The apparatus according to claim 16 further comprising a scraping member attached to said elongate cleaning head, said scraping member serving to scrape obstructions from the channel of said smelt spout.

19. The apparatus according to claim 18 wherein said scraping member comprises a plate having a shape like a cross-sectional area of the channel of said smelt spout.

20. The apparatus according to claim 18 wherein said scraping member is pivotally attached to said elongate cleaning head, the pivotal movement of said scraping member being in a direction of normal flow of the smelt in the channel of said smelt spout, said scraping member being pivotally retractable to a position adjacent to said elongate cleaning head when said cleaning head is actuated by said actuating mechanism into said smelt spout, and said scraping member being pivotable downward into the channel of said smelt spout to urge obstructions out of the channel when said cleaning head is retracted by said actuating mechanism.

* * * * *

UNITED STATES PATENT AND TRADEMARK OFFICE

CERTIFICATE OF CORRECTION

PATENT NO. : 4,706,324

DATED : November 17, 1987

INVENTOR(S) : BYRON L. GOODSPEED

It is certified that error appears in the above-identified patent and that said Letters Patent is hereby corrected as shown below:

On the title page:

Abstract, line 13, "an" should be --and--.

Column 1, line 42, "tubs" should be --tube--.

Signed and Sealed this

Twenty-seventh Day of March, 1990

*Attest:*

JEFFREY M. SAMUELS

*Attesting Officer*

*Acting Commissioner of Patents and Trademarks*